US006732644B2

(12) United States Patent
Frankenberger

(10) Patent No.: US 6,732,644 B2
(45) Date of Patent: May 11, 2004

(54) METHOD FOR PRODUCING AN EFFECT UPON AN EMULSION IN A PRINTING MACHINE

(75) Inventor: Eckart Frankenberger, Darmstadt (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/898,258

(22) Filed: Jul. 3, 2001

(65) Prior Publication Data

US 2002/0000171 A1 Jan. 3, 2002

(30) Foreign Application Priority Data

Jul. 3, 2000 (DE) ..... 100 32 281

(51) Int. Cl.[7] ..... B41F 31/00
(52) U.S. Cl. ..... 101/350.3; 101/352.06
(58) Field of Search ..... 101/349.1, 350.1, 101/350.2, 350.3, 350.4, 350.5, 350.6, 351.1, 351.2, 351.3, 351.4, 351.5, 351.6, 351.7, 351.8, 352.01, 352.03, 352.04, 352.05, 352.06, 352.07, 352.08, 352.09, 352.1, 352.11, 352.12, 352.13, 364, 365, 366, 367, 480, DIG. 34

(56) References Cited

U.S. PATENT DOCUMENTS

| | | | | | |
|---|---|---|---|---|---|
| 4,485,737 A | * | 12/1984 | Jeschke | ..... | 101/365 |
| 4,527,479 A | * | 7/1985 | Dahlgren et al. | ..... | 101/350.5 |
| 4,665,409 A | | 5/1987 | Behrens et al. | | |
| 5,117,752 A | | 6/1992 | Micheli | | |
| 5,226,364 A | | 7/1993 | Fadner | | |

FOREIGN PATENT DOCUMENTS

| | | | | | |
|---|---|---|---|---|---|
| DE | 29 48 486 A1 | | 6/1981 | | |
| DE | 42 13 636 A1 | | 10/1992 | | |
| DE | 198 27 295 A1 | | 12/1999 | | |
| JP | 58 076 278 | | 5/1983 | | |
| JP | 62 134 264 A | | 6/1987 | | |
| JP | 62158047 A | | 7/1987 | | |
| JP | 02-088243 | * | 3/1990 | ..... | B41F/35/02 |
| JP | 03090359 A | | 4/1991 | | |
| SU | 751 659 | | 7/1980 | | |
| WO | PCT/SE91/00400 | | 12/1991 | | |
| WO | WO 91/18744 | | 12/1991 | | |

* cited by examiner

*Primary Examiner*—Thinh Nguyen
*Assistant Examiner*—Julian D. Huffman
(74) *Attorney, Agent, or Firm*—Laurence A. Greenberg; Werner H. Stemer; Ralph E. Locher

(57) ABSTRACT

A method for producing an effect upon an emulsion formed of a printing ink and a dampening solution on a roller in a printing machine includes introducing oscillations produced by an oscillation exciting device of the printing machine, which oscillates at a frequency corresponding to that of ultrasound, into the emulsion on the roller; and a device suitable for performing the method.

11 Claims, 2 Drawing Sheets

METHOD FOR PRODUCING AN EFFECT UPON AN EMULSION IN A PRINTING MACHINE

BACKGROUND OF THE INVENTION

Field of the Invention

The invention relates to a method of producing an effect upon or influencing an emulsion formed of a printing ink and a dampening solution in a printing machine, and further to a printing machine suitable for performing the method.

Brief changes in pressure existing between rollers in a printing machine, or differences in a peripheral surface speed in a printing machine can be caused by an applicator roller rolling over a cylinder gap in a printing-form cylinder or by a ductor or vibrator roller striking another roller, or by similar abrupt or intermittent loading and unloading of an inking or dampening unit. In emulsion films on the two rollers affected by the changes, the changes result in streak-like or strip-like faults being formed in the emulsion, which are transferred from the rollers to a printing form on the printing-form cylinder, and considerably reduce the printing quality.

In order to counter this problem, consideration has heretofore been given to measures which suppress the sudden shocks and the onward transmission thereof, such as roller covers or blankets which absorb the shocks in a resilient or elastic and damping manner, and particularly stiff roll bearings. These measures have, however, not been able to reduce the emulsion strips or streaks to the extent hoped for.

The use of ultrasonic waves in printing machines is known in principle, but not with respect to the problems explained hereinabove.

For example, the published international patent document WO 91/18744 describes a method of eliminating gas bubbles in a printing ink which is used for flexographic or gravure printing, wherein ultrasonic energy is introduced into the printing ink, and foam formation is reduced in this manner. The ultrasonic energy can be supplied to the printing ink via anilox or gravure rolls, ink troughs or chambered doctor blades equipped with ultrasonic actuators.

A further example of the use of ultrasonic waves in printing machines is a method, described in the published Japanese Patent Document JP-SHO 62-134264 for supplying a printing ink to a gravure printing form, wherein, according to one of a number of embodiments, ultrasonic waves focused by a lens are aimed at the gravure printing plate. As is known, an emulsion formed of printing ink and a dampening solution is not used in gravure printing.

Yet another example of the use of ultrasonic waves in printing machines is a method described in the published Japanese Patent Document JP-HE1 3-90359 for controlling the water content of a printing ink emulsion in an inking unit. In this method, by an ultrasonic oscillator disposed in a water separation device, the printing ink emulsion is separated into printing ink, on the one hand, and into water, on the other hand. During the separation, the printing ink emulsion is not on any roller in the inking unit, but in the water separation device.

In addition, the published German Patent Document DE 198 27 295 A1 describes a metering device for a liquid medium, wherein the medium is set into vibration by a vibration element. The vibration element can be constructed as an ultrasonic transmitter acting upon the surface of a dip roller. The medium is either varnish or dampening solution but, in no case, an emulsion formed of a printing ink and a dampening solution.

The aforementioned published patent documents WO 91/18744, JP-SHO 62-134264, JP HEI 3-90359, and DE 198 27 295 A1 therefore provide no suggestion whatsoever regarding a solution for the problems outlined hereinbefore, namely, strip-type or streak-type emulsion faults and, with regard to the invention, merely represent more remote prior art.

SUMMARY OF THE INVENTION

It is accordingly an object of the invention to provide a method for producing an effect upon an emulsion in a printing machine by which the printing quality is improved, and to provide a printing machine suitable for performing the method so as to improve the printing quality.

With the foregoing and other objects in view, there is provided, in accordance with a first aspect of the invention, a method for producing an effect upon an emulsion formed of a printing ink and a dampening solution on a roller in a printing machine, which comprises introducing oscillations produced by an oscillation exciting device of the printing machine, which oscillates at a frequency corresponding to that of ultrasound, into the emulsion on the roller.

In accordance with another mode, the method of the invention includes setting the roller into oscillating by the oscillation exciting device.

In accordance with a further mode, the method of the invention includes providing the oscillations introduced into the roller with a frequency corresponding to that of ultrasound.

In accordance with an added mode, the method of the invention includes providing the oscillations of the roller as axial oscillations thereof.

In accordance with an additional mode, the method of the invention includes providing ultrasonic waves from an ultrasonic source disposed externally to the roller and functioning as the oscillation exciting device for forming the introduced oscillations, and directing the ultrasonic waves to the emulsion on the roller.

In accordance with yet another mode, the method of the invention includes aiming the ultrasonic waves at the emulsion approximately in the radial direction of the roller.

In accordance with yet a further mode, the method of the invention includes focusing the ultrasonic waves on a peripheral area of the roller.

In accordance with a second aspect of the invention, there is provided a printing machine having a roller for carrying an emulsion formed of a printing ink and a dampening solution, comprising an oscillation exciting device oscillating with a frequency corresponding to that of ultrasound, said oscillation exciting device being assigned to said roller for setting said roller oscillating.

In accordance with another feature of the printing machine according to the invention, the oscillation exciting device is disposed in the roller.

In accordance with a further feature of the printing machine according to the invention, the oscillating exciting device is of piezoelectric construction.

In accordance with an added feature of the printing machine according to the invention, the roller includes a roller shaft and a roller sleeve for carrying the emulsion, the roller sleeve being mounted on the roller shaft so as to be excited to oscillate in the longitudinal direction of the roller shaft by the oscillation exciting device.

In accordance with an additional feature of the printing machine according to the invention, the roller is an applicator roller rollable on a printing form.

In accordance with yet another feature of the printing machine according to the invention, there is provided a roller for carrying an emulsion formed of a printing ink and a dampening solution, and at least one ultrasonic source disposed adjacent to and separate from the roller, the ultrasonic source being directed toward the roller.

In accordance with yet a further feature of the printing machine according to the invention, the ultrasonic source is aimed at a peripheral surface of the roller.

In accordance with yet an added feature of the printing machine according to the invention, the ultrasonic source is aimed at a peripheral area of the roller located between two contact lines.

In accordance with yet an additional feature of the printing machine according to the invention, the ultrasonic source is of piezoelectric construction.

In accordance with a concomitant feature of the printing machine according to the invention, the roller is an applicator roller rollable on a printing form.

In the method according to the invention for producing an effect upon or influencing an emulsion formed of a printing ink and a dampening solution on a roller in a printing machine, oscillations produced by an oscillation exciting device of the printing machine, which for this purpose oscillates at a frequency corresponding to that of ultrasound, are introduced into the emulsion on the roller.

The invention is thus based on the finding that, under the assumption that the emulsion in this case is located as a thin emulsion film on a peripheral surface of the roller, emulsification can be promoted by the fact that the oscillation exciting device oscillates at the ultrasonic frequency. This finding is completely opposed to the method disclosed by the published Japanese Patent Document JP-HEI 3-90359, wherein de-emulsification is to be promoted by the ultrasound.

A printing machine according to the invention, having a roller that carries an emulsion formed of a printing ink and a dampening solution, is distinguished by the fact that the roller has an oscillation exciting device assigned thereto that sets the roller into oscillations, and oscillates at a frequency corresponding to that of ultrasound.

As a result of the oscillations of the roller, and the emulsion on the latter, the emulsification of the dampening solution with the printing ink is improved over the entire part of the peripheral surface of the roller that is covered by the emulsion. An inking unit including the roller or a plurality of such rollers excited to oscillate require, overall, fewer rollers than a conventional inking unit, in order to make the printing ink ready.

A further embodiment of the printing machine according to the invention, having a roller carrying an emulsion formed of a printing ink and a dampening solution, is distinguished by the fact that at least one ultrasonic source aimed at the roller is disposed adjacent the roller.

Due to the ultrasonic waves from the ultrasonic source, which strike the emulsion on the rotating roller, the emulsification is likewise improved. Strip-like or streak-like emulsion faults are eliminated by the ultrasonic waves, even before the emulsion faults can be transferred, in a manner similar to ghosting, from the roller to another roller or a printing form or plate.

Other features which are considered as characteristic for the invention are set forth in the appended claims.

Although the invention is illustrated and described herein as including a method for producing an effect upon an emulsion in a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
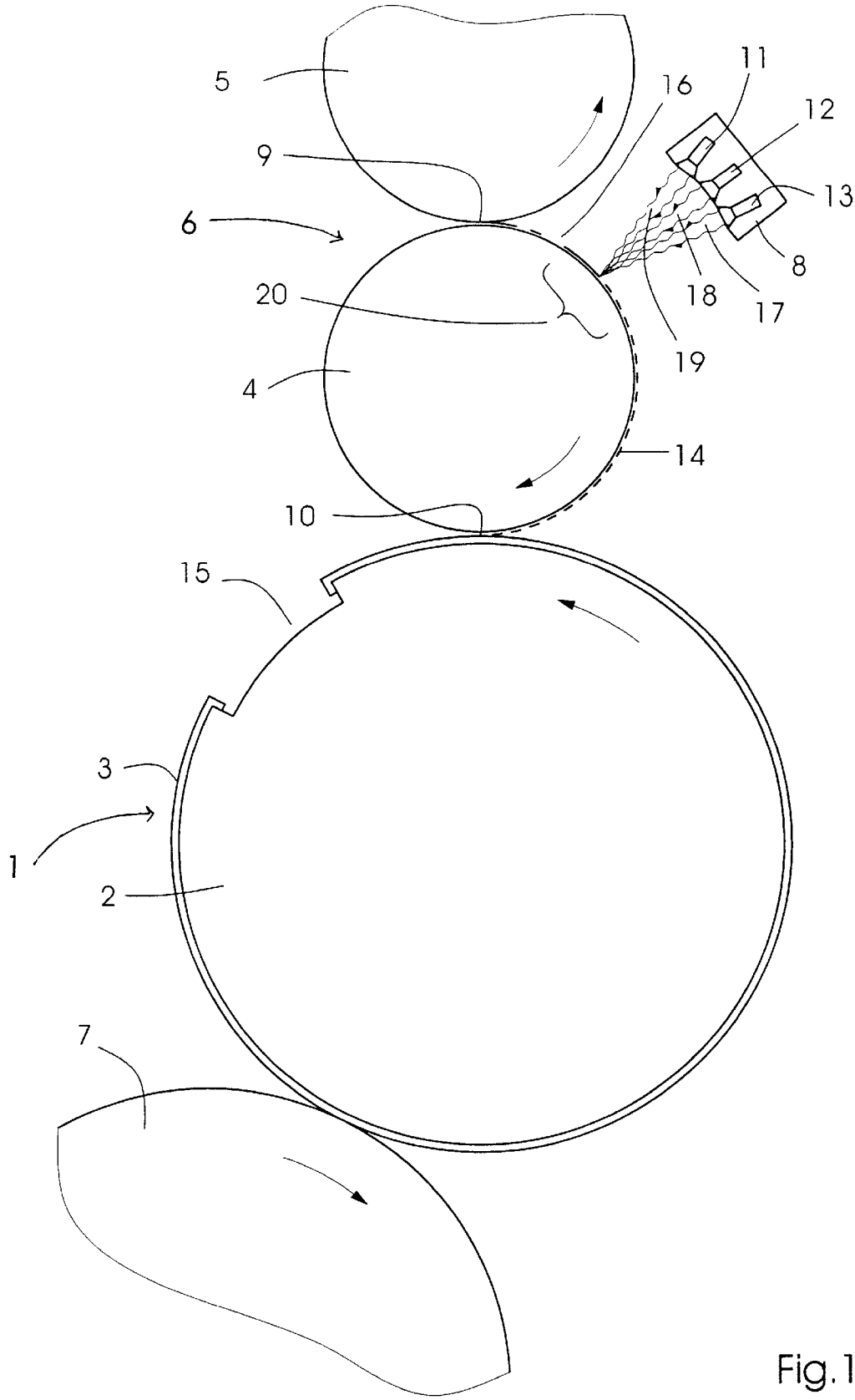
FIG. 1 is a fragmentary diagrammatic side elevational view of a printing press suitable for performing the method according to the invention, having, in a first exemplary embodiment, a roller and an oscillation exciting device disposed separately from the roller.

Referring now to the drawings and, first, particularly to FIG. 1 thereof, there is shown therein a detail of a printing machine 1. The detail shows a printing-plate cylinder 2 with a printing form or plate 3, whereon a roller 4, such as an applicator roller, rolls. The printing plate 3 is a planographic printing plate for offset printing. The roller 4, which is rubber-covered and softly elastic, and a roller 5 driving the roller 4 by friction are constituent parts of an inking unit 6 of the printing machine 1, of which only a detail is shown. In order to dampen the printing plate 3, the printing machine 1 contains a dampening unit including rollers, which is of a conventional type and, therefore, is believed to require no illustration or further description. The roller 5, which is a chromium-plated hard roller, is an axially reciprocating distributor roller.

As viewed in the direction of rotation of the printing-form cylinder 2, the roller 4 rests on the printing form or plate 3 as the last roller of the inking unit 6 upline from a blanket cylinder 7. In the printing machine 1, an oscillation exciting device assigned to the roller 4 and constructed as an ultrasonic source 8 is focused on a peripheral area of the roller 4 which, as viewed in the direction of rotation of the roller 4, is disposed downline from a common contact line of the rollers 4 and 5 and upline of a common contact line 10 of the roller 4 and the printing form or plate 3. The contact line 9 is a liquid pick-up line, and the contact line 10 is a liquid discharge line of the roller 4. The ultrasonic source 8 is composed of piezoelectric elements 11, 12, 13 and extends over the axial length of the roller 4 which is covered by a film-like printing-ink/dampening-solution emulsion 14.

The ultrasonic source 8 functions as follows:

A shock caused during rolling of the rollers 4 and 5 on one another and, for example, by rolling over a cylinder gap 15 formed in the printing-form or plate cylinder 2, can lead to an emulsion fault 16 which is streak-like or strip-like and extends parallel to the contact line 9 within the otherwise undisturbed emulsion 14. When the roller 4 enters the cylinder gap 15, the pressure and slippage between the rollers 4 and 5 in the area of the contact line 9 are reduced abruptly. When the roller 4 emerges from the cylinder gap 15, the pressure and the slippage are increased again abruptly. The pressure and the slippage, i.e., the peripheral surface speed ratio, between the rollers 4 and 5 are variables which produce an effect upon or influence the emulsification of the printing ink and of the dampening solution on the roller 4, the abrupt changes of which produce the emulsion fault 16. In order to homogenize the disturbed emulsion 14 as much as is possible, and to reduce the prominence of the emulsion fault 16 in the printed image, by focused ultrasonic waves 17, 18, 19 from the ultrasonic source 8, not only the emulsion fault 16 but the entire surface of the film of the emulsion 14 is treated as it is transported past the ultrasonic source 8. As a result of the incident ultrasonic waves 17, 18, 19, the roller 4 and the emulsion 14 on the latter are caused to oscillate, the frequency of the oscillation being in the range typical for ultrasound. Consequently, the dampening solution and the printing ink, which are highly de-emulsified locally by the shock in the area of the emulsion fault 16, emulsify again rapidly. The elimination of the emulsion fault 16 is performed even before the latter reaches the contact line 10 and can be transferred to the printing plate 3. The intensity of the ultrasonic waves 17, 18, 19 can be varied by adjusting the ultrasonic source 8 appropriately. Depending upon the adjustment of the intensity, various degrees of emulsification of the emulsion 14 on the roller 4 can be set. In addition to the action of the aforedescribed ultrasonic waves 17, 18, 19 and improving the emulsification directly within that peripheral area 20 of the roller 4 wherein the ultrasonic waves 17, 18, 19 are incident, the latter also have a remote action within the nip or the contact line 9 between the rollers 4 and 5. The roller 4 set into microscopic oscillations relative to the roller 5 by the ultrasonic waves 17, 18, 19 effect regular microscopic disturbances in the emulsion 14. The "microscopic disturbances" which are deliberately generated and caused continuously during printing are superimposed on the undesired and much more intense emulsion fault 16, with the result that the latter is barely apparent in the printed image even if it has not been possible, by using the ultrasonic source 8, to eliminate the emulsion fault 16 completely before transfer thereof to the printing form or plate 3.

Figure 2:
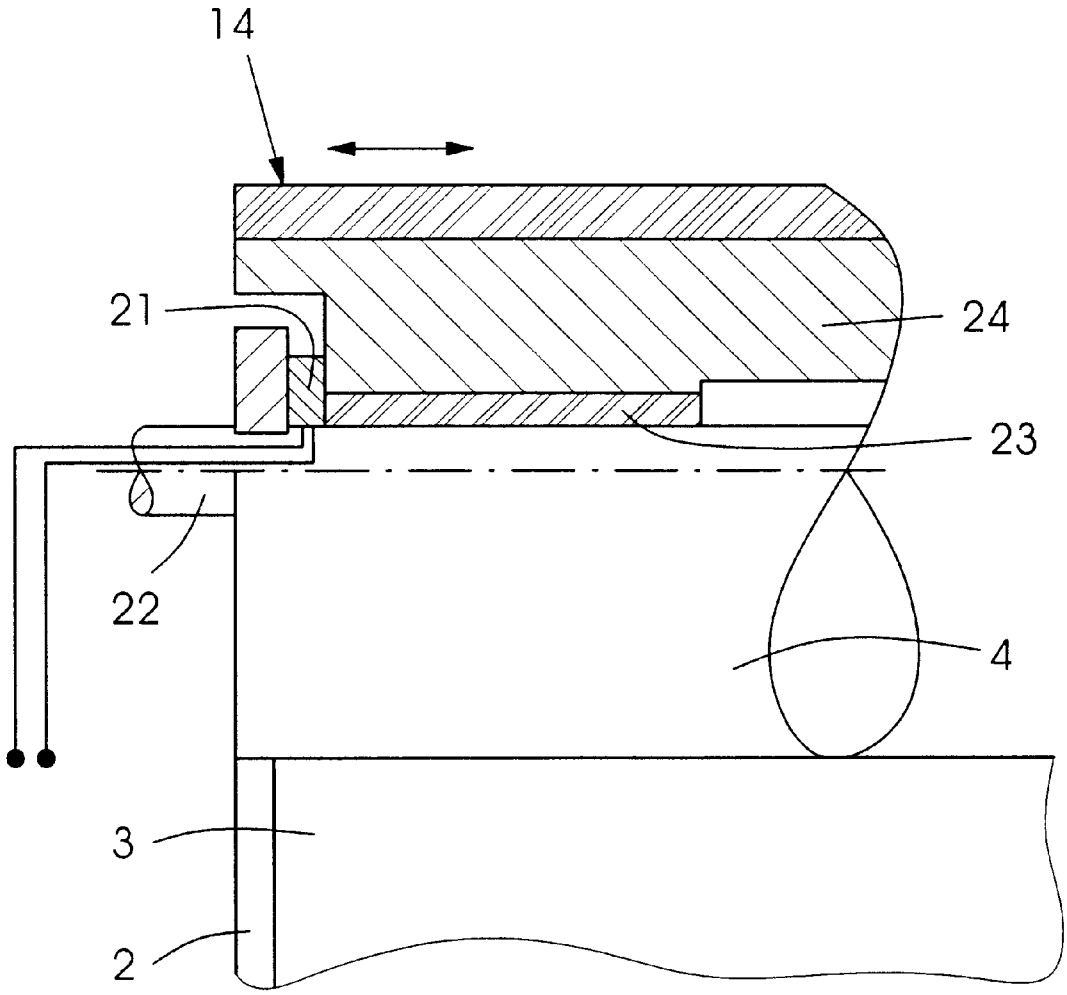
FIG. 2 is a fragmentary front elevational view, partly in section, of FIG. 1 having, in a second exemplary embodiment, an oscillation exciting device disposed in the roller.

FIG. 2, which illustrates another embodiment of the invention, shows that the roller 4 has a further oscillation exciting device 21 assigned thereto, which sets the roller 4 oscillating at a frequency corresponding to that of ultrasound and which, for example, can be switched on instead of the ultrasonic source 8. It believed to be apparent that the roller 4 is of multipartite construction and includes a roller shaft 22, and a roller sleeve 24 which is mounted on the roller shaft 22 so that it can be rotated by a slide bushing 23 and displaced axially. The oscillation exciting device 21, which is constructed as a piezoelectric element, is supported with one side thereof on the roller shaft 22, and can also be supported on a different part fixed to the frame. With the other side thereof, the oscillation exciting device 21 presses against a side face of the roller sleeve 24 and a side face of the slide bushing 23 which merges into the latter side face. By appropriate energization, the oscillation exciting device 21 is set into an ultrasonic oscillation which the oscillation exciting device 21 transfers to the roller sleeve 24 via the side thereof resting on the roller sleeve 21, so that consequently, these microscopic oscillations in axial directions of the roller 4 are imposed at a frequency corresponding to that of ultrasound. As a result of these axial microscopic oscillations, the emulsification behavior of the emulsion 14 is improved not just in the area of the emulsion fault 16 but over the entire peripheral surface of the roller sleeve 24. Provision can be made, in addition to providing the roller 4, for a further roller, preferably a further ink applicator roll, or further rollers, preferably further ink applicator rollers, belonging to the inking unit 6 and equipped with an oscillation exciting device corresponding, in constructional and functional terms, to the oscillation exciting device 21. Likewise, a dampening solution applicator roller belonging to the dampening unit mentioned hereinbefore can be equipped with an oscillation exciting device corresponding to the oscillation exciting device 21. The use of the oscillation exciting device 21 disposed between the roller shaft 22 and the roller sleeve 24 makes it possible to reduce the total number of rollers in the inking unit 6 as compared with a conventional inking unit, which, in order to achieve good emulsification, requires a comparatively large number of rollers, and to construct the inking unit 6 as a so-called short-form inking unit.

I claim:

1. A method for producing an effect upon an emulsion formed of a printing ink and a dampening solution which comprises:

introducing oscillations produced by an oscillation exciting device with a frequency corresponding to that of ultrasound, into the emulsion on an applicator roller rolling on a printing form and into the applicator roller as axial oscillations causing the applicator roller to oscillate in an axial direction.

2. The method according to claim 1, which comprises providing ultrasonic waves from an ultrasonic source disposed externally to the roller and functioning as the oscillation exciting device for forming the introduced oscillations.

3. A printing machine, comprising:

a roller for carrying an emulsion formed of a printing ink and a dampening solution;

an oscillation exciting device oscillating with a frequency corresponding to that of ultrasound causing said roller to oscillate;

a roller shaft and a roller sleeve for carrying the emulsion, said roller sleeve being mounted on said roller shaft so as to be excited to oscillate in a longitudinal direction of said roller shaft relative to said roller shaft by said oscillation exciting device.

4. The printing machine according to claim 3, wherein said oscillation exciting device is disposed in said roller.

5. The printing machine according to claim 3, wherein said oscillating exciting device is of piezoelectric construction.

6. A printing machine, comprising:

an applicator roller rolling on a printing form carrying an emulsion formed of a printing ink and a dampening solution; and an oscillation exciting device oscillating with a frequency corresponding to that of ultrasound causing said applicator roller to oscillate, said oscillation exciting device being disposed in said applicator roller.

7. The printing machine according to claim 6, wherein said oscillating exciting device is of piezoelectric construction.

8. A printing machine comprising:

an applicator roller rolling on a printing form carrying an emulsion formed of a printing ink and a dampening solution, and at least one ultrasonic source disposed adjacent to and separate from said applicator roller, said ultrasonic source being directed toward said applicator roller.

9. The printing machine according to claim 8, wherein said ultrasonic source is aimed at a peripheral surface of said applicator roller.

10. The printing machine according to claim 9, wherein said ultrasonic source is aimed at a peripheral area of said applicator roller located between two contact lines.

11. The printing machine according to claim 8, wherein said ultrasonic source is of piezoelectric construction.

* * * * *